US011725835B2

(12) United States Patent
Rao et al.

(10) Patent No.: US 11,725,835 B2
(45) Date of Patent: Aug. 15, 2023

(54) ENERGY EFFICIENT AND REFRIGERANT-FREE AIR COOLER

(71) Applicants: Vempati Venkata Sundereswar Rao, Secunderabad (IN); Vempati Kalyanram, Aurora, IL (US); Samsasiva Rao Chagarlamudi, Cary, NC (US)

(72) Inventors: Vempati Venkata Sundereswar Rao, Secunderabad (IN); Vempati Kalyanram, Aurora, IL (US); Samsasiva Rao Chagarlamudi, Cary, NC (US)

( * ) Notice: Subject to any disclaimer, the term of this patent is extended or adjusted under 35 U.S.C. 154(b) by 165 days.

(21) Appl. No.: 17/485,441

(22) Filed: Sep. 26, 2021

(65) Prior Publication Data

US 2022/0214057 A1 Jul. 7, 2022

(51) Int. Cl.

| | |
|---|---|
| ***F24F 5/00*** | (2006.01) |
| ***F24F 13/28*** | (2006.01) |
| ***F24F 13/30*** | (2006.01) |

(52) U.S. Cl.

CPC ..... *F24F 5/0035* (2013.01); *F24F 13/28* (2013.01); *F24F 13/30* (2013.01)

(58) Field of Classification Search

CPC ..... F24F 5/0035; F24F 13/28; F24F 13/30

See application file for complete search history.

(56) References Cited

U.S. PATENT DOCUMENTS

| | | | | |
|---|---|---|---|---|
| 4,335,781 | A * | 6/1982 | Duffy | F28D 15/02 165/41 |
| 6,695,896 | B2 * | 2/2004 | Hara | F02M 25/0854 96/132 |
| 2003/0111420 | A1 * | 6/2003 | Dresty, Jr. | B01J 19/0086 210/695 |
| 2004/0237781 | A1 * | 12/2004 | Terada | F24F 8/125 96/290 |
| 2007/0151278 | A1 * | 7/2007 | Jarvis | F24F 1/0007 62/310 |

(Continued)

FOREIGN PATENT DOCUMENTS

| | | |
|---|---|---|
| CN | 205279327 | 6/2016 |
| CN | 209415646 | 9/2019 |

(Continued)

*Primary Examiner* — Kun Kai Ma

(74) *Attorney, Agent, or Firm* — Law Offices of Steven W. Weinrieb

(57) ABSTRACT

The invention discloses an energy efficient refrigerant-free air cooler comprising a housing (7); a porous ceramic honeycomb monoliths (2) horizontally positioned and parallel to one another, which is in constant contact with a tray or tank of water (6) maintained at a constant level; a set of thin walled pipes (4) made of conductive material are positioned in a suspended fashion by means of perforated sheets (16*a*,16*b*) and in each one of the channels of the honeycomb so as to be positioned in the water tray (6) leaving free spaces/passages around the peripheries of the pipes (4). A blower (20) blows air through the free spaces around the peripheries of the pipes in one direction and cools the surroundings. Another blower (15) blows air in any one direction through the conductive thin-walled pipes and gets cold due to the cold surroundings inside the channels, resulting in cold air at the exit ends of the pipes.

13 Claims, 3 Drawing Sheets

(56) References Cited

U.S. PATENT DOCUMENTS

| | | | | |
|---|---|---|---|---|
| 2009/0155141 | A1* | 6/2009 | Arai | B01J 8/0453 422/204 |
| 2011/0209858 | A1 | 9/2011 | Konno | |
| 2013/0152557 | A1* | 6/2013 | Brugger | F01N 3/106 422/168 |
| 2013/0224410 | A1* | 8/2013 | Nozawa | B29C 70/342 428/117 |
| 2013/0287378 | A1* | 10/2013 | Kida | H05B 3/141 392/465 |
| 2013/0333407 | A1* | 12/2013 | Jarvis | F28C 3/08 62/314 |
| 2016/0025329 | A1* | 1/2016 | Vempati | F22B 1/284 392/402 |

FOREIGN PATENT DOCUMENTS

| | | |
|---|---|---|
| KR | 201183208 | 7/2011 |
| WO | WO9015958 | 12/1990 |

* cited by examiner

ENERGY EFFICIENT AND REFRIGERANT-FREE AIR COOLER

FIELD OF THE INVENTION

This invention relates to an energy efficient refrigerant-free air cooler which is very cost effective. The air is indirectly cooled by allowing it to pass through plurality of thin-walled metallic pipes positioned inside the channels of wet ceramic honeycomb. This air cooler is capable of providing very cold air, free of excess moisture unlike the conventional air cooler.

BACKGROUND OF THE INVENTION

Many methods have been devised to generate cold air by evaporative cooling and many prior art devices exist. Most of those devices generate cold air with some or more moisture content in the exit air. None of those devices attempted to eliminate moisture in the cooled air being provided by them.

CN205279327 discloses an energy-conserving and environment-protective type service water cold type air conditioner, water cooled condenser are cover tubular structure, the fan setting on the casing, water cooled condenser by freezing liquid union coupling to evaporimeter, the water regulating valve setting is on coolant liquid pipe, the coolant liquid guan zaiyu compressor that is connected to the evaporimeter is connected, the compressor is connected with the water cooled condenser, the utility model discloses an it is high to adopt heat exchange coefficient, small water cooled condenser, the air conditioner can adopt monolithic structure, there is not the off-premises station part, and is advantaged by energy saving and environmental protection, advantage with low costs and install easy maintenance, and can the make full use of condensation send out heat, noise and hot-blast pollution to the border environment that room external fan produced had both been eliminated, save the family again and burnt the hydrothermal energy, the water regulating valve adopts the elastic element to temperature sensitive to drive the case removal, can be according to the change automatic regulating valve door degree of opening of condenser leaving water temperature, and can eliminate the water pressure of running water and the influence of temperature fluctuation, the storing pallet rack is highly practical.

CN209415646 discloses a kind of indirect-evaporation cooling devices of enclosed pre-cooling, first exhaust blower and spray equipment are set in cabinet, water tank is arranged in the lower section of filler, first surface air cooler is set between filler and water tank, the first outlet pipe of water tank is connected to plate heat exchanger primary side, its outlet is connected to spray equipment, and plate exchanger secondary side is connected to the import of the first surface air cooler, and outlet is connected to the import of plate exchanger secondary side or first the air side of surface air cooler enclosed coil pipe is set, the outlet of enclosed coil pipe is connected to the import of the first surface air cooler, and outlet is connected to the import of enclosed coil pipe, and the outlet of water tank is connected to spray equipment. The utility model is structurally reasonable, and the enclosed operation may be implemented in the two-stage pre-cooling surface air cooler of indirect evaporation water chiller, avoids security risks brought about by open water systems, improves the safety of use in winter, outdoor cryogenic air is made full use of, and energy-saving and water-saving reduces the invalid heat loss of plate heat exchanger.

KR20110083208 teaches a cooling system performing cooling function is provided to perform a cooling function without using a cooling device by using the lower temperature of cold water of river and sea. A cooling system comprises a water tank (110), a first heat exchanger (120), and a second heat exchanger (130). The water tank has an inflow pipe in which the low water of temperature flows. The first heat exchanger makes the lower temperature seawater, which flows through the inflow pipe, to be mixed with general water. The second heat exchanger can generate cool air by mixing the inflow outside air which flows through an air intake pipe.

WO 1990015958 discloses an evaporative air-cooling apparatus comprising a water container (7) and an array (5) of discrete lengths (6) of capillary material the lower ends of which depend into the water container (7). The lengths (6) of capillary material become wetted with water from said water container (7) by surface tension alone and air passed over said lengths (6) of capillary material is cooled by the evaporation of water from said array (5). The air gets cooled but carries all the moisture along with it and such cool air is suitable only in dry atmospheric regions of the world and fails to address air conditioning needs where humidity levels need to be low. Direct evaporative cooling always increases the moisture in the useful air.

Some other prior art teaches indirect evaporative cooling methods and the used air is cooled within a heat exchanger wherein it exchanges indirectly with cooling water. The air cools down by releasing its own heat to the water which in turn is cooled in some sort of cooling towers where the absorbed heat is released to the atmosphere and the cold water returns to the cycle. Since there is no evaporation of the moisture which is present in the inlet air, such continues to be there and the air with moisture enters the conditioning room.

Some indirect evaporation devices employ cold water pipes as heat exchangers which also minimize humidity carryover to the conditioned room. However, the need to have two heat exchanging points increases the labor, cost of manufacture, and also the cost of operation.

Freon based Air conditioners are altogether not desired and efforts need to be made to eliminate CFC (chlorofluorocarbons) based systems totally.

US 2011/0209858 discloses a device for indirect evaporative cooling comprising of a substrate disposed between a wet channel used to induce an evaporation phenomenon and a dry channel through which cooled air passes, the dry and wet channels are layered alternately, the substrate is formed out of plastic sheet with plurality of spacers and embossed patterns on its sides to allow zigzag movement of air. This device has a limitation of poor efficiency as the heat transfer is through a poorly conductive plastic and is laborious to manufacture.

Summing up, the limitations in the prior art devices are the complicated manufacturing method, the durability, the presence of moisture in the produced air, and ease of maintenance, simplicity of technique, minimizing fuel requirements and dependence on ozone-depleting fluorocarbons Accordingly, there is a need for an improved indirect evaporative air-cooling device which can operate with maximum efficiency, can be assembled easily, and can minimize the operational cost while reducing the evaporation losses without sacrificing on output quality of air suitable for air conditioning the rooms. Thus, it eliminates the need for CFCs or chemicals and minimizes power consumption and has a very low carbon footprint in its operation unlike the CFC air conditioner.

Such a device would reduce the utilization of the ozone depleting CFC dependent air conditioners, and make available an economical and highly energy efficient indirect evaporative cooling device that can reach the homes of the poorest of the poor.

OVERALL OBJECTIVES OF INVENTION

Hence it is an object of the present invention to make an energy efficient air cooler that provides cold air, free of excess moisture, unlike the conventional air cooler, without the use of any refrigerant for effecting cooling.

Another objective of the invention is to totally eliminate CFCs or any ozone depleting chemicals but provides cool air like any other air conditioner.

Yet another objective of the present invention is to provide cold air by indirect cooling of the air by evaporating the water.

One more objective of the invention is to avoid the use of multiple heat exchanger units as found in the known indirect evaporative air-cooling devices thereby reducing the cost of manufacture and cost of operation.

Yet another objective of the invention is to reduce the power requirements drastically compared to the Freon based air conditioners.

One more objective of the invention is the gainful utilization of the water evaporation phenomenon on the channel walls of the ceramic honeycomb and the subsequent drop in temperature of the internal channel walls surface and its vicinities.

Yet another objective of the present invention is to minimize the moisture content in the cool air so-produced so that this can serve as a good air conditioning device.

Another objective of the present invention is to produce cool water for drinking or any other use One more objective of the present invention is to utilize the cool moist air which is a byproduct to serve as a cooling medium for any other application.

SUMMARY OF INVENTION

The above-mentioned objectives of the present invention have been achieved utilizing the porous ceramic honeycomb monolith. Numerous pores present in the body of the honeycomb behave like a bunch of capillary tube network and suck water along its channel walls when bottom portion of the ceramic honeycomb is in contact with in water. Similarly, when the top surface of the honeycomb is wetted it sucks water along its channel wall and percolates towards the other end. Once air is blown through the moist honeycomb, water evaporates and cools the surroundings. This property is made use of by blowing air through the metal tubes passing through the ceramic honeycomb, resulting in the cooling of the air, without the air being in direct contact with water. Thus, the air being cooled will not be moist unlike the conventional coolers.

More particularly, according to the present invention, the energy efficient evaporative cooling device comprises: a) a housing (7); b) one or more porous ceramic honeycomb monoliths (2) having rectangular or circular channels disposed parallel to one another with their axes disposed within a substantially horizontal plane, and wherein a portion of the channels are constantly submerged in water and resting within a tray or tank of water (6); c) a set of thin-walled pipes (4) made of heat conductive material positioned in a suspended fashion in each of the channels of the ceramic honeycomb monolith above the water level, held by means of perforated sheets (16*a*,16*b*) as supports in such a way so as to leave free spaces/passages (5) around the peripheries of the pipes (4) in the channel (3) of the ceramic honeycomb (2) so as to facilitate the free passage of air, when air is blown through the passages (5), that can result in the evaporation of the water absorbed by the ceramic honeycomb walls (21) while one end of each thin-walled pipe (4) performs as an air inlet for the air cooler and the other end of each thin-walled pipe (4) performs as an air outlet as the pipes (4) pass through the perforated sheet (16*a*), the enclosure (17*a*), the respective channel of the honeycomb (2), the enclosure (17*b*), and finally the perforated sheet (16*b*), so as to terminate at the exit end of the pipe (4) into the chamber requiring to be cooled; d) a first blower (20) with pre-filter (28) that blows a stream of air into the enclosure (17*a*), and the said free spaces/passages (5) around the peripheries of the pipes (4) in one direction and making the spaces (5) around the pipes (4) cool due to the evaporation of the occluded moisture resulted due to the absorption of water in the pores of the ceramic honeycomb walls and exit through the vent (11) in the enclosure (17*b*); and e) a second blower (15) with a pre-filter (22) that blows a stream of air through the conductive thin-walled pipes (4) which would have become cold due to the cold surroundings inside the channel, resulting in cooling of the air within the pipes (4) and the discharge of cold air at the exit of the pipes (4) which is used for cooling the room where the cooler is positioned.

According to an aspect of the invention, the main body (7) of the cooler is provided with a rigidly suspended water tray (6) by means of bracket (26) provided with an overflow spout (8) and the bottom portion of the main body (7) functions as the main reservoir of water. The ceramic honeycomb monolith (2) has a plurality of channels (3) disposed within a horizontal plane and are positioned in the water tray (6) by means of support (13) in such a way that two to three channels (3*b*) will be always immersed within the water (10). The number of channels depends upon the size of the honeycomb, which in turn depends on the capacity of the cooler, which further depends on the area to be cooled. Water level is maintained by means of a submersible water circulation pump (14) which continuously provides water to the water tray/tank (6) required for wetting the ceramic honeycomb monolith (2).

According to another embodiment under the invention, the main cooler body (7) also contains the main water holding tank (6); a ceramic honeycomb (2) monolith with its channels (3) disposed within a horizontal plane which is held on the rim (29) of the water tank above the water level in the water tank. An assembly of perforated pipes (23) are positioned above the ceramic honeycomb (2) so as to spray/drip water onto the honeycomb (2) and an electric submersible water circulation pump (14) is provided to circulate water from the water reservoir to the assembly of pipes (23) through a valve (24) located in its path to regulate the quantity and flow of water being sprayed/dripped over the honeycomb (2) required for wetting the ceramic honeycomb monolith (2).

The size of the honeycomb is chosen in such a way that an equidistance is maintained from the water tray (6) on both sides which form the inlet enclosure (17*a*) and outlet enclosure (17*b*) for the air required for the evaporative cooling of the channel wall (21) of the honeycomb (2).

The thin-walled pipes (4) are made from heat conducting materials selected from copper, aluminum, stainless steel, and metalized or conductive polymer material and extends out from both ends of the ceramic honeycomb monolith (2) and will fit into the corresponding holes of the perforated polymer or metallic support sheets (16*a*,16*b*) which are rigidly screwed to the walls of the main body (7). These perforated sheets (16*a*,16*b*) are positioned at a distance on both ends of the ceramic honeycomb (2). All the other open sides formed on either side of the extended pipes on both ends will be suitably closed/sealed with a metallic sheet to create enclosures or chambers (17*a*,17*b*).

The enclosure (17*a*) is provided with an air blower (20) which draws the air from the atmosphere through a filter (28) and forces the air into the free spaces (5) formed around the peripheries of the thin-walled pipes (4) and the channels (3) of the ceramic honeycomb (2) where it promotes the evaporation of water in the channel walls (21), thereby cooling the channel walls (21) of the honeycomb (2), causing a severe drop in temperature in the free spaces (5) thereby, in turn, cooling the thin-walled pipes (4) and, in turn, the air passing through the thin-walled pipes (4) so as to finally exit to atmosphere through the vent (11) in the enclosure (17*b*). The main body (7) is provided with another air blower (15) with a prefilter (22) outside of the enclosure (17*a*) so as to blow air into the openings of the thin-walled pipes (4) which gets cooled and enters the room that is to be cooled which is again recirculated by the air blower (15). This recirculation of air through the thin-walled pipes (4) reduces the air temperature of the room on the order of about 10° C. to 20° C. without increasing the moisture content appreciably.

The size of the honeycomb is chosen in such a way that an equal distance is maintained from the water tray on both the side which forms the inlet chamber (17*a*) and outlet chamber (17*b*) for the air required for the evaporative cooling of the channel wall of the honeycomb (2).

According to another embodiment under the invention provision can be made to direct the flow of cooled air in the most efficient way by providing airflow flaps that can be manually adjustable or automatically swing up and down, evenly dispersing the cooled air.

Many more embodiments are possible with minor variations to the features disclosed in the exemplary embodiment disclosed in the forgoing paragraphs, while maintaining the following unique features:

(a) It is observed that by this invention, we can generate a cold flow of moisture-free air unlike conventional evaporative air coolers, and can also can eliminate the use of harmful CFCs and other organic chemicals, high pressure compressors etc., and can be scaled up suitably to meet the specific requirements in terms of space requiring to be cooled.

b) The improved evaporative air cooler minimizes the power requirements and is commercially viable for large scale production at an affordable cost.

c) Besides the above-mentioned embodiments which were disclosed herein, various modified configurations involving, ceramic honeycomb arrangement, channel shape, channel size, wall thickness, porosity, materials of constructions are feasible.

BRIEF DESCRIPTION OF THE DRAWINGS

These and other objects, features and advantages of the present invention will become apparent from the following description of the preferred process when read in conjunction with the accompanying drawings which illustrate, by way of the explanation, the operation of the present invention, and wherein.

DETAILED DESCRIPTION OF THE ILLUSTRATED EMBODIMENTS

According to the present invention the energy efficient refrigerant free air cooler, which is an evaporative cooling device, comprises a housing, one or more porous ceramic honeycomb monoliths with their channels horizontally positioned parallel to one another, and a portion of channels submerged in the circulating water available in the water tank, or under a spray of water so that a few or all the channels of the honeycomb are wetted at any given instant. These ceramic honeycomb monoliths can have channels of either rectangular or circular cross section. A set of thin-walled pipes made of conductive material are positioned in a suspended fashion in the channels of the ceramic honeycomb leaving free passages around the peripheries of the pipes for the free passage of air. The micro-pores present within the body of the ceramic honeycomb effectively behave like a capillary tube network and suck water along its channel walls as the bottom portion of the ceramic honeycomb is submerged in water. Similarly, when the top surface of the honeycomb is wetted by a spray of water or by dripping water thereon, then it also sucks water along its channel walls and percolates towards the bottom portion. When air is blown through the free passages around the peripheries of the pipes within the channels of the honeycomb, water within the walls evaporates and cools the surroundings resulting in the cooling of the thin-walled pipes positioned within the channels of the ceramic honeycomb monolith. When the air to be cooled is blown through one end of these cold thin-walled pipes, the air passing through the pipes automatically gets cooled and come out cooled as a result of the exchange of heat. The details of the invention will now be explained in accordance with various embodiments of the invention.

Figure 1:
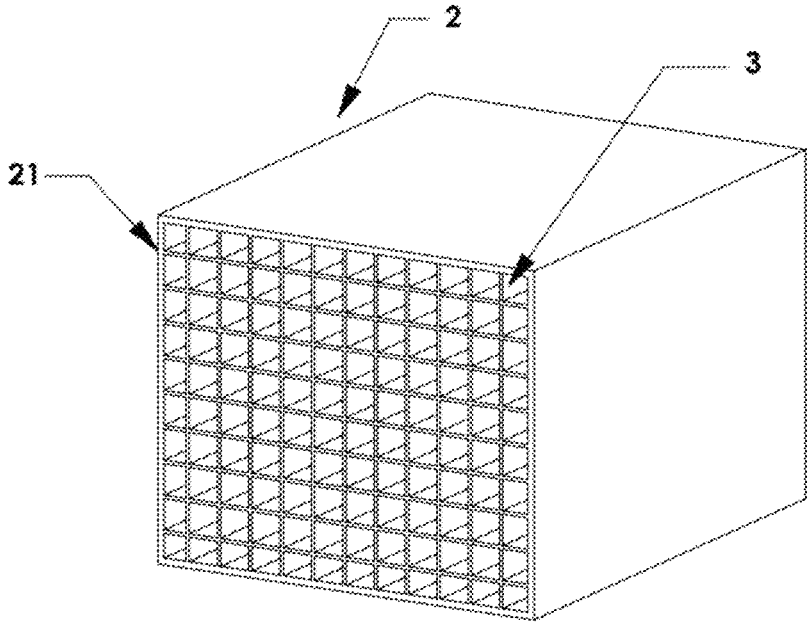
FIG. 1 shows an isometric view of a basic ceramic honeycomb body.

FIG. 1 is an isometric view of the ceramic honeycomb (2) in its bare form, shows the channel spaces (3) with walls (21) for better understanding of the invention.

Figure 2:
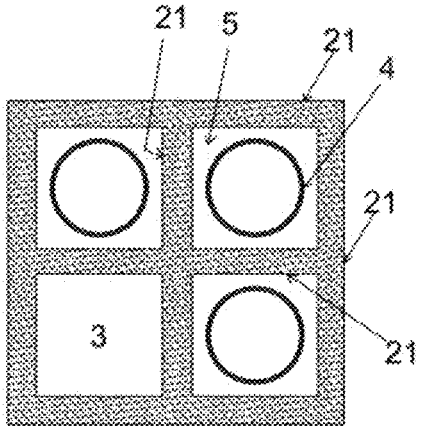
FIG. 2 shows a magnified image of a cross section of a few individual channels and walls of the ceramic honeycomb with conductive pipes in suspension to show more details.

FIG. 2 shows a very enlarged cross-sectional image of the channel and pipe arrangement so as to illustrate the channels (3) wherein one of the channels has had its pipe (4) and free space (5) omitted for clarity. It also shows the fine particle conglomerate constituting the porous ceramic honeycomb (2) channel walls (21), the expanded view of the peripheral or free spaces (5), and the pipes (4) in suspension within the channels (3).

Figure 3:
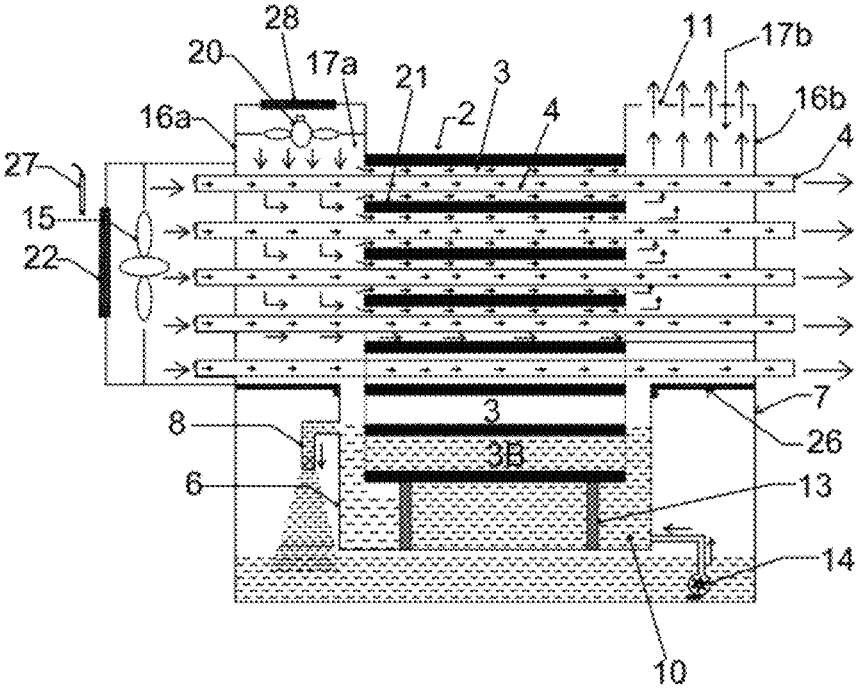
FIG. 3 shows a basic design and the cross-sectional view of the ceramic honeycomb-based energy efficient refrigerant free air cooler.

FIG. 3 shows a cross-sectional schematic view of the energy efficient refrigerant-free air cooler according to a preferred embodiment of the present invention.

As shown in FIG. 3, a main body or reservoir (7) of the cooler is provided with a rigidly suspended water tray or water storage tank (6) with an overflow spout (8) which is held by means of bracket (26). The bottom portion of the main body (7) functions as the main reservoir of water required for cooling and is provided with a submersible water circulation pump (14) which continuously provides water to maintain the requisite level in the water tray (6) required for wetting the partly submerged ceramic honeycomb monolith (2).

A ceramic honeycomb monolith (2) has a number of channels (3) disposed within a horizontal plane and are positioned within the water tray (6) by means of a suitable support (13) in such a way that one to two channels (3*b*) will be always immersed within the water (10) so that a constant level within the water tray (6) is always maintained by virtue of the overflow spout (8) provided therein, and excess water will fall into the main reservoir (7), at the bottom portion of the main body, and is recirculated to the water tray (6). The number of channels provided within the ceramic honeycomb monolith depends upon the size of the honeycomb, which in turn depends on the capacity of the cooler, which is based upon the envisaged area to be cooled. The size of the honeycomb and the inserted conductive pipes and the disposition of the perforated sheets are chosen in such a way that an equal distance can be maintained on both sides of the honeycomb so as to allow the construction of enclosures (17*a*,17*b*) for the air required for the evaporative cooling of the channel walls of the honeycomb.

The thin-walled pipes (4) made of conductive material are positioned in a suspended fashion in each one of the channels of the ceramic honeycomb monolith (2) positioned within the water tray (6) above the water level leaving free spaces (5) around the peripheries of the pipes (4) within the channels (3) of the ceramic honeycomb (2), thereby facilitating the free passage of air when blown through the honeycomb (2).

The thin-walled pipes (4) are made out of any known heat conducting materials like copper, aluminum, stainless steel, or any known metalized or conductive polymer material. The pipes (4) extend out from the channels (3) on both ends to a predetermined distance. All the pipes (4) extending out from both ends of the ceramic honeycomb monolith (2) will be fit into corresponding holes of the perforated polymer or metallic support sheets (16*a*,16*b*) positioned at a distance on both ends of the ceramic honeycomb (2). These pipes (4) will have cross-sectional sizes lesser than the channel cross sections so that a peripheral or free space (5) is created between the periphery of the pipe (4) and the walls (21) of the channel (3). The perforated sheets (16*a*,16*b*) will be rigidly screwed to the walls of main body (7) of the cooler. All of the other open sides formed on either side of the extended pipes on both ends will be closed with a metallic sheet to create enclosures or chambers (17*a*,17*b*) with both enclosures (17*a* &17*b*) having an opening at the top.

One end of the thin-walled pipes (4) is the air inlet of the air cooler and the pipe (4) itself passing through the perforated sheet (16*a*), the enclosure (17*a*) respective channel of the ceramic honeycomb, the enclosure (17*b*), and finally the perforated sheet (16*b*) and terminating at the air exit end into the chamber requiring air conditioning.

The chamber (17*a*) is provided with an air blower (20) in the opening at the top, so as to draw air in from the atmosphere through a filter (28) and force this air into the enclosure (17*a*) and further into the peripheral or free spaces (5) defined between the thin-walled pipes (4) and the channel walls (21) of the ceramic honeycomb (2) and into the enclosure (17*b*) and out through the vent (11) located in the opening at the top of enclosure (17*b*) to atmosphere or a location where cold moist air can be of use.

A temperature sensor (27) is available at the entrance end of the conductive pipes (4) for sensing the temperature in the room to be cooled and to activate the blowers and water pump according to a set or predetermined temperature.

Figure 4:
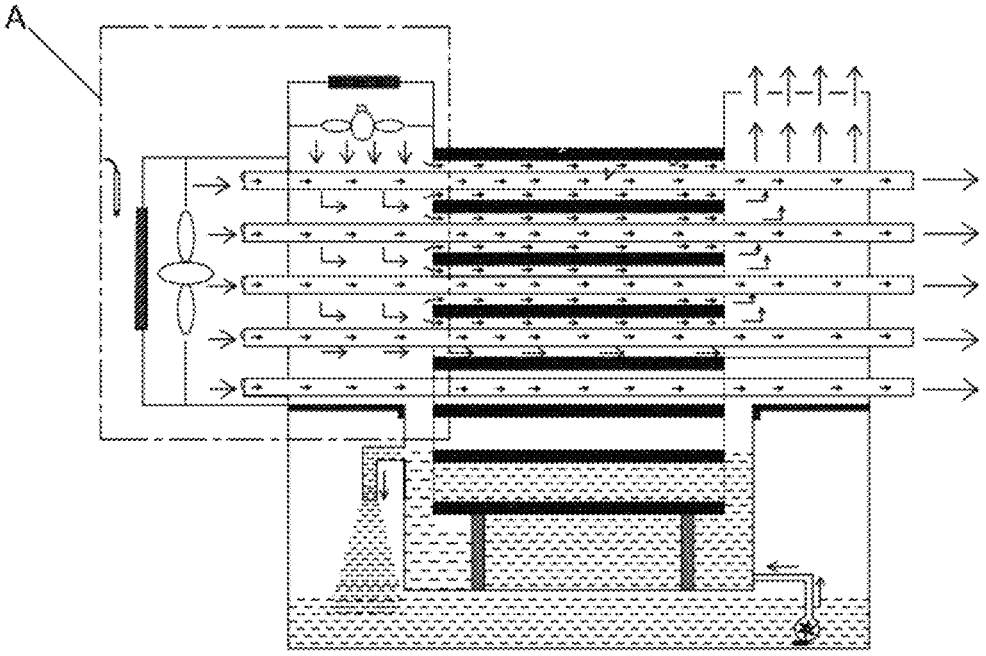
FIG. 4 shows the basic design of the ceramic honeycomb based indirect evaporative cooling device with a highlighted portion A for better appreciation of the invention.

FIG. 4 shows the part of the FIG. 3 that explains the flow path of two different streams of air through the honeycomb (2) with a portion A of the image in dotted lines to identify and enlarge that portion in the next figure for offering more clarity of the different flow patterns of the involved fluids.

Figure 5:
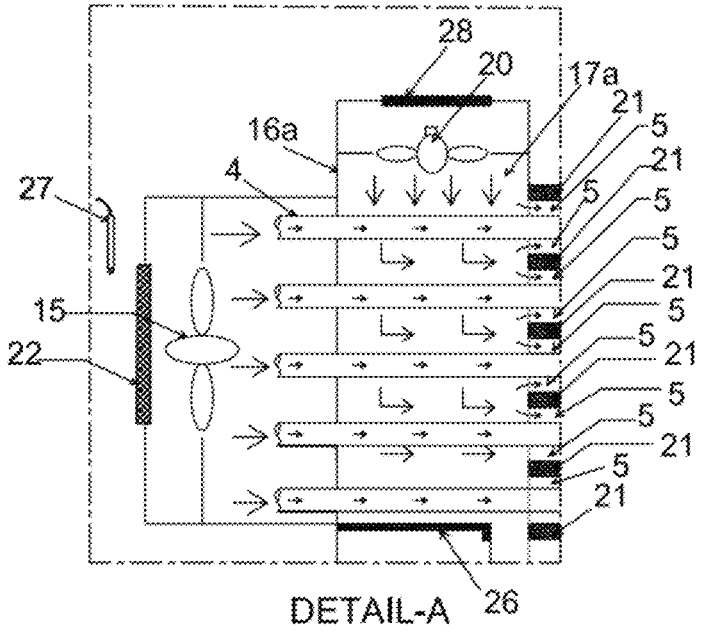
FIG. 5 shows an expanded image of the highlighted portion A of the FIG. 3 where an attempt has been made to show the flow pattern of air from different fans within the cooler.

FIG. 5 shows an enlarged cross-sectional image of a portion of FIG. 4, highlighted as A in FIG. 4, showing the flow path of two different streams of air through the honeycomb (2) with the conductive thin-walled pipes (4) positioned in a suspended fashion between the walls (21) of the horizontally disposed ceramic honeycomb (2) relatively freely due to their opposite ends being fixed within the perforations of the perforated plates 16*a*,16*b*.

A first blower (15) with a pre-filter (22) is provided to blow a stream of air through the pipes (4).

The second blower (20), provided with the pre-filter (28), blows a stream of air around those portions of the conductive thin-walled pipes (4) that are disposed within enclosure 17*a*, and then such air also flows through the spaces (5).

Figure 6:
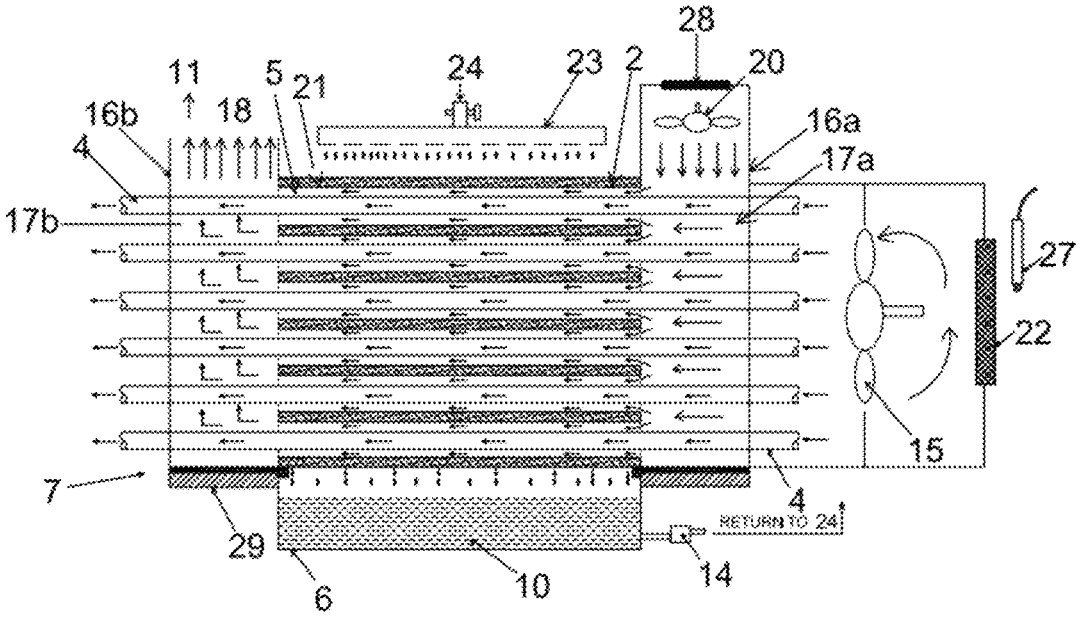
FIG. 6 shows another embodiment under the invention with conductive pipes in all the channels of ceramic honeycomb with water dripping over the ceramic honeycomb body, instead of keeping few channels of the honeycomb immersed in the water available in the water tray.

FIG. 6 shows the cooler according to another embodiment under the invention. The main body (7) also contains the main water holding tank (6), a ceramic honeycomb (2) monolith with its channels (3) in a horizontal plane and attached to the rim (29) of the water tank (6). An assembly of perforated pipes (23) are positioned above the ceramic honeycomb (2) so as to spray/drip water onto the honeycomb (2) and an electric submersible water circulation pump (14) circulates water from the water reservoir (6) to the assembly of pipes (23) through a valve (24) located in its path to regulate the quantity and flow of water being sprayed over the honeycomb (2). The ceramic honeycomb (2) which is rigidly held on the rim (29) of the water tank (6) has all its channels (3) above the water level in the water tank (6).

Thin-walled pipes (4), made of conductive material, are positioned in a suspended fashion within each one of the channels (3) of the ceramic honeycomb monolith (2) leaving free peripheral spaces (5) around the pipes (4) in the channels (3) of the ceramic honeycomb (2), thereby facilitating the free passage of air when blown through the free space (5).

The thin-walled pipes (4) are made out of any known heat conducting material like copper, aluminum, stainless steel, or any known metalized or conductive polymer material. The pipes (4) extend out from the channels (3) on both ends thereof to a predetermined distance out from the main body (7). All the pipes (4) extending out from both ends of the ceramic honeycomb monolith (2) are fastened to the corresponding holes of the perforated polymer or metallic support sheets (16*a*,16*b*) positioned at a distance from both ends of the ceramic honeycomb (2).

The perforated sheets (16*a*,16*b*) are rigidly screwed to the walls of main body (7). All of the other open sides formed on either side of the extended pipes (4) on both ends of the honeycomb monolith (2) will be closed with a metallic sheet to create enclosures or chambers (17*a*,17*b*).

Here also, the thin-walled pipes (4) are positioned in a suspended fashion within each one of the channels (3) of the ceramic honeycomb monolith (2) so as to leave free spaces (5) around the peripheries of the pipes (4) in the channel (3) of the ceramic honeycomb (2) thereby facilitating free passage of air when air is blown through the same. These pipes (4) will have cross sectional dimensions less than the cross-sectional size of the channels (3) itself so that a peripheral free space (5), as seen in FIGS. 4 and 6, exists between each pipe (4) and the walls (21) of FIGS. 2 and 5 of the channel (3).

The main body (7) is provided with an air blower (15) with a pre-filter (22) so as to blow air into the thin-walled conductive pipes (4) from one end and to allow the air to pass through the heat conductive pipes (4) positioned within the channels (3) of the honeycomb (2), and thereby get cooled and provide cool air in the room that is to be cooled. Thus, the air passing through the thin-walled pipes (4) continuously results in the reduction of the air temperature of the room on the order of about 10° C. to 20° C. without increasing the moisture content appreciably.

According to an embodiment under the invention, provision can be made to direct the flow of cooled air in the most efficient way. This can be accomplished by providing airflow flaps that can be manually adjustable or automatically pivot upwardly and downwardly, evenly dispersing the cooled air. In general, an airflow during cooling should be directed as high as possible, since all the warm air is always at the top. The pivotal functions not only allow a flap to be fixed at any position but to also make it constantly deflect air upwardly and downwardly.

Working of the Device

The working of the energy efficient refrigerant free air cooler of the present invention is simple and will do away with the complicated compressors, ozone depleting CFCs, and also drastically reduces power consumption.

The submersible water circulation pump (14) of the water holding tank feeds the tray (6) to the level of the overflow sprout (8) thus maintaining the water level in the tray (6). When water (10) enters those channels (3*b*) that are submerged within the water (10), the porous ceramic body soaks up the water and the water (10) travel up the walls (21) of FIG. 2 of the channels (3) that are disposed above the water within the tray (6) owing to the micro-porosity within the ceramic body (2) that acts as a network of capillaries and will wet the ceramic honeycomb (2) existing above the water level in the tray (6). Since the ceramic honeycomb monolith (2) has many channels (3) and hence many walls (21), an inherently porous body with a very large surface area is made available and this large surface forms a very large evaporating surface. As is known, the evaporation of water on the surface causes the lowering of surface temperature of the ceramic honeycomb channel walls (21). Naturally the air passing through the free spaces (5) between the pipes (4) and the channels (3) gets cooled considerably as long as the evaporation continues. The occluded moisture level of the air within the channels (3) is continued to be maintained as the ceramic honeycomb (2) sucks water from the water tray (6). In view of the above evaporation process the lowering of temperature occurs, and when air is blown into these conductive thin-walled pipes (4) from one end, the air exiting from the other end will be at a relatively lower temperature.

The temperature within the conductive pipes (4) will continue to drop until the evaporation of water from the channel walls (21) continues. This is ensured by the second blower fan (20).

When air is blown into the enclosure (17*a*) by the blower fan (20), the air passes through the peripheral spaces (5) around the conductive pipes (4) and accelerates the evaporation process of water from the channel walls (21). This evaporation leads to a drop in temperature around the conductive pipes (4), When the fan (15) blows air through the conductive pipes (4), the air travelling through the pipe (4) will lose its heat and will cool down. The cooling process is dependent upon evaporation and hence the fan (20) in the enclosure (17*a*) must be continuously operated to achieve the desired results. A temperature sensor (27) at the outlet of the filter pad (22) will activate the fans and the water pump. Hence, we can set the temperature as it is feasible to bring down the temperature in the room in the order of about 10° C. to 20° C. without increasing the moisture content appreciably.

The air originating from the air blower (20) at the top of the enclosure (17*a*) passes through the free spaces (5) around the pipes (4) within the channels (3) and after evaporating the moisture in the channel walls (21), such results in the drop of temperature within the walls (21), and the surroundings within the channels (3), the conductive pipes (4), as well as losing its own heat, passes out into the enclosure (17*b*), and finally to the vent (11) and out into the atmosphere or gainfully used for some other purpose where humidified cool air is required.

The main difference between the first and second embodiments of the invention is the way in which the honeycomb is wetted. In the first case, it is through the suction of the water by the channels (3) of the ceramic honeycomb (2), while in the second embodiment, the water is sprayed onto the top surface of the honeycomb (2).

Exemplary Operation

For the purpose of demonstrating the functioning of the energy efficient refrigerant free air cooler according to an exemplary embodiment of the invention, we carried out a trial, the details of which are as follows. The prototype energy efficient refrigerant-free air cooler used in the example has the following important dimensional features:

A ceramic honeycomb of 10 mm square channels having one hundred sixty-nine channels with 150 mm width, 150 mm height, and 300 mm long with a wall thickness of 1.4 mm;

The lower three rows of a total of thirty-nine channels were submerged within the water within the tray and the rest of the one hundred thirty channels were provided with aluminum pipe of 8 mm diameter having a wall thickness of 0.4 mm with 50 mm of the 400 mm length pipe disposed upon both sides of the channels;

Pipes were suspended with the support of SS 304 perforated sheets (16*a*,16*b*) that had the perforations laser cut to suitable design so as to allow the correct suspended positioning with uniform peripheral spaces around the pipe (4) within the channels (3). The airtight enclosure (17*a*,17*b*) with vents on the top is made out of PVC sheets.

A blower (20) is fixed over one opening at the top of the enclosure 17*a* so as to suck air from out from the room while the other opening had arrangement to disperse the air from this blower to a place outside the room to be cooled as it contains moisture;

One more blower (15) of 25 watts was arranged in front of the pipe openings so as to force air into the pipes (4) on one end, the other ends of the pipes were left open so as to permit the cooled air to be discharged into the room to be cooled;

One RTD (Resistance Temperature Detector) sensor with a temperature indicator was disposed within the room so as to measure the temperature within the room to be cooled;

One wet and dry bulb humidity unit was disposed within the room so as to measure the humidity within the room;

The power was switched ON to the air cooler so that the blowers as well as the recirculation pumps started working.

Results

Case 1—The air cooler was disposed inside in one corner of the room. Ambient air within the room to be cooled was 41° C. initially, and the RH was 56%. After twenty minutes of running the cooler, it was observed that the temperature of the room to be cooled had been reduced to 30° C., and after thirty minutes of running the cooler, it was observed that the temperature of the room to be cooled had been reduced to 27° C., which stabilized at such temperature level and which showed a reduction in temperature of 14° C. from the initial temperature of 41° C. The RH recorded in the room was 65%, which comprised an acceptable increase in RH since there was no condensation or removal of air.

Case 2—The air cooler was shifted to the window facing the sun in the same room. Ambient air in the room to be cooled was 41° C. and the RH was 56%. After twenty minutes of running the cooler, it was observed that the temperature of the room to be cooled had been reduced to 29° C., and after thirty minutes of running the cooler, the temperature of the room to be cooled had been reduced to 24° C., which stabilized at such temperature level and which showed a reduction in temperature of 17° C. from the initial temperature of 41° C. The RH recorded in the room was between 65% and 70%, which comprised an acceptable increase in RH since there was no condensation or removal of air.

The results can be improved further with improvements in quality of fabrication during regular production of the cooler to get better cooling effect, that is, a drop in temperature.

From the above examples it can be readily concluded that it is very possible to reduce the temperature of the air, or to cool the air, by this invention without the use of CFCs and without an increase in humidity levels.

Advantages

As a result of the foregoing, the following advantages are noted:

1) Most importantly—Zero or minimum carbon footprint
2) Zero usage of CFCs and other organic substances
3) No Compressors are needed.
4) Drastic reduction in power required during usage. Power is required only for running the fans and a miniature water circulation pump. The invention can even be a solar powered DC source.
5) Easily available raw materials. Clay required for making the honeycomb monolith is abundantly available everywhere.
6) Very economical—it is a poor man's air conditioner.
7) Can be window mounted.
8) Two types of cool air can be generated simultaneously
   1) Cold air free of moisture that can be used in places where moisture is not desired.
   2) Cold air containing moisture for general cooling applications.
9) Cool drinking water can be produced without the use of additional power or any refrigerant and with even lesser than connected load if desired.

We have brought out the novel features of the invention by explaining some of the preferred embodiments under the invention, enabling those in the art to understand and visualize our invention. It is also to be understood that the invention is not limited in its application to the details set forth in the above description or as illustrated in the drawings with reference to the utilization of the phenomenon of water absorbing nature of the porous honeycomb body to get higher evaporation rates. Although the invention has been described in considerable detail with reference to certain preferred embodiments thereof, various modifications can be made without departing from the scope of the invention as described herein above and as defined in the appended claims.

What we claim as new and desired to be protected by Letters Patent is:

1. An energy efficient refrigerant-free air cooler comprising:

a housing (7);

one or more numbers of porous ceramic honeycomb monoliths (2) having rectangular or circular channels horizontally positioned and parallel to one another, wherein a portion of channels with their axis horizontal or slightly inclined, which is in constant contact with water and resting in a tray or tank of water (6);

a set of thin-walled pipes (4) made of conductive material positioned in a suspended fashion by means of perforated sheets (16*a*, 16*b*) and in each of the channel of the ceramic honeycomb monolith that is not immersed in the water but in constant contact with the water in the water tray (6) leaving free space/passage around the periphery of the pipe in the channel of the ceramic honeycomb facilitating free passage of air when blown through the same wherein one end of the thin-walled pipe is the air inlet of the air cooler and the pipe is passing through the perforated sheet (16*a*), inlet enclosure (17*a*) and then entering the respective channel of the honeycomb;

the other end of the thin-walled pipe is the cooling air outlet of the air cooler, which after passing through the respective channel of the honeycomb, outlet enclosure (17*b*) and terminates after passing through the other perforated sheet (16*b*);

a first blower (20) with pre-filter (28) that blows a stream of air through said free space/passage around the periphery of the pipe and making said space around the pipe cool due to the evaporation of the occluded moisture resulted due to the absorption of water in the pores of the ceramic honeycomb and exit through the vent (11); and a second blower (15) with a pre-filter (22) that blows a stream of air through said conductive thin-walled pipe and the air gets cooled due to the cold surroundings inside the channel, resulting in cold air at the exit of these pipes which is used for cooling the room which is desired to be cooled.

2. The energy efficient refrigerant-free air cooler as claimed in claim 1, wherein:

the main body (7) of the cooler is provided with a rigidly suspended water tray (6) by means of bracket (26) provided with an over flow spout (8) and the bottom portion of the main body (7) functions as the main reservoir of water and the ceramic honeycomb monolith (2) having channels (3) in horizontal axis are positioned in the water tray (6) by means of support (13) in such a way that 2 to 3 channels (3*b*) will be always immersed in the water (10) and water level is maintained by means of a submersible water circulation pump (14) which continuously provides water to the water tray (6) required for wetting the ceramic honeycomb monolith (2).

3. The energy efficient refrigerant free air cooler as claimed in claim 1, wherein:

the number of channels (3) provided in the honey ceramic honeycomb monolith (2) depends on the size of the honeycomb, which in turn depends on the capacity of the cooler, which is decided based on the envisaged area to be cooled by said air cooler.

4. The energy efficient refrigerant free air cooler as claimed in claim 1, wherein:

the main cooler body (7) also contains the main water holding tank/tray (6); a ceramic honeycomb (2) monolith with its channels (3) in horizontal axis is held on the rim (29) of the water tank/tray (6) above the water level in the water tank/tray (6); an assembly of perforated pipes (23) are positioned above the ceramic honeycomb (2) to spray/drip water on the honeycomb and an electric submersible water circulation pump (14) is provided to circulate water from the water reservoir to the assembly of pipes through a valve (24) located in its path to regulate the quantity and flow of water being sprayed/dripped over the honeycomb required for wetting the ceramic honeycomb monolith (2).

5. The energy efficient refrigerant free air cooler as claimed in claim 1, wherein:

the size of the honeycomb is chosen in such a way that an equidistance is maintained from the water tray (6) on both the side which forms the inlet enclosure (17*a*) and outlet enclosure (17*b*) for the air required for the evaporative cooling of the channel wall (21) of the honeycomb.

6. The energy efficient refrigerant free air cooler as claimed in claim 1, wherein:

said thin-walled pipes (4) are made out of heat conducting materials selected from the group comprising copper, aluminum, stainless steel, and metalized or conductive polymer material.

7. The energy efficient refrigerant free air cooler as claimed in claim 1, wherein:

said thin walled pipes (4) extend out from both ends of the ceramic honeycomb monolith (2) and are tightly fitted within corresponding holes of the perforated polymer or metallic support sheets (16*a*,16*b*), which is rigidly screwed to the walls of the main body (7), positioned at a distance on both ends of the ceramic honeycomb (2) and all the other open sides formed on either sides of the extended pipes on both ends will be closed with a metallic sheet to create enclosures or chambers (17*a*, 17*b*).

8. The energy efficient refrigerant free air cooler as claimed in claim 1, wherein:

the enclosure or chamber (17*a*) for the honeycomb is provided with an air blower (20) which draws atmospheric air through a filter (28) and forces in to the space around the periphery of the thin walled pipe and the channel of the ceramic honeycomb and out of the outlet enclosure or chamber (17*b*), after cooling the channel wall of the honeycomb, thereby cooling the thin walled pipe and the air passing through the said pipe and finally exit back to atmosphere.

9. The energy efficient refrigerant free air cooler as claimed in claim 1, wherein:

the enclosure or chamber (17*a*) is provided with an air blower (15) which draws the air, from the room to be cooled, through a filter (22) and forces it into the thin-walled pipes (4) which is positioned in the channels (3) of the honeycomb (2), where the air gets cooled and re-enters the room that is to be cooled.

10. The energy efficient refrigerant free air cooler as claimed in claim 1, wherein:

the size of the honeycomb is chosen in such a way that an equidistance is maintained from the water tray on both the side which forms the inlet chamber (17*a*) and outlet chamber (17*b*) for the air required for the evaporative cooling of the channel wall of the honeycomb.

11. The energy efficient refrigerant free air cooler as claimed in claim 1, wherein:

a temperature sensor is provided at the outlet of the filter pad (22) which can activate the blowers (15,20) and the submersible water recirculation pump (14) so that required temperature in the room can be set enabling to bring down the temperature in the order of 10 to 20° C. without increasing the moisture content appreciably.

12. The energy efficient refrigerant free air cooler as claimed in claim 1, wherein:

provision can be made to direct the flow of cooled air in the most efficient way by providing airflow flaps that can be manually adjustable or automatically swing up and down, evenly dispersing the cooled air.

13. The energy efficient refrigerant air cooler as claimed in claim 1, wherein the air cooler can not only bring down the temperature in the intended room/space to be cooled but also can produce cool humid air and cold water.

* * * * *